US012305318B2

(12) United States Patent
Araujo et al.

(10) Patent No.: US 12,305,318 B2
(45) **Date of Patent: *May 20, 2025**

(54) STRUCTURAL ARRANGEMENT INTRODUCED IN A LIQUID DISPENSING SET-UP OF A HOUSEHOLD APPLIANCE

(71) Applicant: WHIRLPOOL CORPORATION, Benton Harbor, MI (US)

(72) Inventors: Rene Luiz Costa Araujo, Sao Paulo (BR); Marcelo Filho Campos Valente, Benton Harbor, MI (US); Emmanuel F. Gonzaga, Sao Paulo (BR)

(73) Assignee: Whirlpool Corporation, Benton Harbor, MI (US)

( * ) Notice: Subject to any disclaimer, the term of this patent is extended or adjusted under 35 U.S.C. 154(b) by 221 days.

This patent is subject to a terminal disclaimer.

(21) Appl. No.: 18/084,792

(22) Filed: Dec. 20, 2022

(65) Prior Publication Data

US 2023/0118393 A1 Apr. 20, 2023

Related U.S. Application Data

(63) Continuation of application No. 17/073,661, filed on Oct. 19, 2020, now Pat. No. 11,591,742, which is a continuation of application No. 16/039,888, filed on Jul. 19, 2018, now Pat. No. 10,829,884.

(30) Foreign Application Priority Data

Jul. 19, 2017 (BR) ..... 2020170155205

(51) Int. Cl.
*D06F 39/08* (2006.01)
*D06F 39/14* (2006.01)

(52) U.S. Cl.
CPC ..... *D06F 39/088* (2013.01); *D06F 39/083* (2013.01); *D06F 39/14* (2013.01)

(58) Field of Classification Search
CPC ..... D06F 37/28; D06F 39/08; D06F 39/083; D06F 39/088; D06F 39/14
See application file for complete search history.

(56) References Cited

U.S. PATENT DOCUMENTS

| | | | |
|---|---|---|---|
| 2,588,535 | A | 3/1952 | Kahn |
| 2015/0211167 | A1 | 7/2015 | Kim et al. |
| 2018/0335246 | A1 | 11/2018 | Jeong et al. |
| 2019/0024962 | A1 | 1/2019 | Lee et al. |

FOREIGN PATENT DOCUMENTS

| | | | |
|---|---|---|---|
| BR | 102014010905 | A2 | 1/2015 |
| BR | 102014010908 | A2 | 1/2015 |
| EP | 0213385 | A1 | 3/1987 |

*Primary Examiner* — Joseph L. Perrin
(74) *Attorney, Agent, or Firm* — Price Heneveld LLP

(57) ABSTRACT

A structural arrangement introduced in a liquid dispensing set-up of a household appliance includes at least one feed pipe, at least one movable lid cooperating with a fixed body, and at least one liquid flow driver. The liquid flow driver is disposed adjacent a lower face of the movable lid. The liquid flow driver is associated with the feed pipe through a fluid connector. The fluid connector defines a hinge axis of the movable lid. The liquid flowing through the liquid flow driver is directed inside of at least one washing environment defined in an inside of the household appliance.

20 Claims, 3 Drawing Sheets

STRUCTURAL ARRANGEMENT INTRODUCED IN A LIQUID DISPENSING SET-UP OF A HOUSEHOLD APPLIANCE

CROSS-REFERENCE TO RELATED APPLICATIONS

This present application is a continuation of U.S. patent application Ser. No. 17/073,661 filed Oct. 19, 2020, now U.S. Patent No. 11,591,742, issued Feb. 28, 2023, entitled STRUCTURAL ARRANGEMENT INTRODUCED IN A LIQUID DISPENSING SET-UP OF A HOUSEHOLD APPLIANCE, which is a continuation of U.S. patent application Ser. No. 16/039,888 filed Jul. 19, 2018, now U.S. Pat. No. 10,829,884, issued Nov. 10, 2020, entitled STRUCTURAL ARANGEMENT INTRODUCED IN A LIQUID DISPENSING SET-UP OF A HOUSEHOLD APPLIANCE, which also claims priority to Brazilian Patent Application No. BR2020170155205, filed Jul. 19, 2017, entitled STRUCTURAL ARRANGEMENT INTRODUCED IN A LIQUID DISPENSING SET-UP OF A HOUSEHOLD EQUIPMENT, the disclosures of which are hereby incorporated herein by reference in their entirety.

FIELD OF THE DEVICE

The present device relates to a structural arrangement introduced in a household appliance and, more specifically, in a set-up for dispensing liquids applied to a movable lid of a top load washing machine.

BACKGROUND OF THE DEVICE

As it is known to those skilled in the art, various types of household laundry equipment, hereinafter referred to as washing machines only, comprise a structural cabinet, within which a washing chamber is defined, in which a washing tank and a washing basket are arranged and accessed through a front or top opening, depending on the type of washing machine (front load or top load, respectively), the opening being regulated by a movable lid.

In a plurality of washing machine models, a kind of plastic frame defining the aperture for the washing basket is associated with the structural cabinet, provides an aesthetic finish, and supports the movable lid, among other functions.

In general, the washing machines include devices capable of promoting the washing of articles, in an aqueous medium. Typically, the aqueous medium consists essentially of water and diluted washing constituents.

Washing machines belonging to the present state of the art typically include, among other mechanisms and systems not relevant to the scope of the device in question, at least one liquid dispensing system/set-up, whose purpose is to convey and direct the liquid towards a washing environment.

Basically, the liquid dispensing set-up includes at least one liquid conduit (pipe or equivalent), at least one liquid flow restriction means (a valve or equivalent), and at least one nozzle (a sprayer, a sprinkler, or the very end of the pipe defining the liquid conduit).

In the state of the art, there are various solutions for liquid dispensing set-ups arranged in a fixed manner or associated with fixed components of the washing machines. This fundamental aspect in common does not usually represent major problems in the operation of the liquid dispensing systems themselves, but can be considered as a limiting factor to the implementation of two washing zones in the same washing machine and in particular the implementation of two zones (one fixed and one removable and optional) in the same washing machine.

The state of the art also discloses liquid dispensing set-ups movably arranged, that is, including at least one of its components associated with a movable component of the washing machine, for example the movable lid, in order to allow the disposal of washing liquid in removable baskets mounted on the agitator tower of the washing machine (auxiliary washing zone).

To exemplify this second type of arrangement, once can refer to documents BR102014010905 and BR102014010908.

Document BR102014010905 specifically discloses a liquid dispensing system of a washing machine in which the nozzle is disposed on the underside of the washer's movable lid and, more particularly, integrated with the hinge member of the washer's movable lid, the fluid connection between the nozzle and at least one source of liquid being accomplished by way of at least one pivot shaft of the hinge member of the movable lid of the washing machine.

Moreover, the document further describes an intermediate pipe, disposed between the nozzle and the fluid connection means, integrated with the hinge member.

In this regard, one can point out that the solution of this document demands the manufacture of a single piece, which defines the nozzle, the hinge component, the fluid connector, and the intermediate pipe, with the single piece being blow-molded.

SUMMARY OF THE DEVICE

Thus, it is the primary purpose of the device in question to disclose a structural arrangement that facilitates the fabrication and assembly of a liquid dispensing set-up for a household appliance.

It is also the purpose of this device to disclose a simple solution that is easy to manufacture and assemble, and is inexpensive.

Furthermore, it is an objective of the present device to provide a functional improvement to the object described in document BR102014010905.

According to a first aspect of the present disclosure, a laundry appliance includes a movable lid that is configured to couple to a fixed body. An intermediate element includes a body having a first end and a second end. A fluid connector is positioned proximate the first end. An intermediate element outlet is positioned proximate the second end. The fluid connector is received within a portion of the fixed body and a coupling between the fluid connector and the portion of the fixed body establishes a hinge axis about which the movable lid is configured to rotate.

According to a second aspect of the present disclosure, a laundry appliance includes a movable lid that is configured to couple to a fixed body. An intermediate element includes a body having a first end and a second end. A fluid connector is positioned proximate the first end. An intermediate element outlet is positioned proximate the second end. The fluid connector is received within a portion of the fixed body. The fluid connector defines a hinge axis about which the movable lid rotates such that a coupling between the fluid connector and the portion of the fixed body establishes the hinge axis about which the movable lid is configured to rotate. A liquid flow driver is disposed adjacent a lower face of the movable lid and fluidly coupled to the intermediate element.

According to a third aspect of the present disclosure, a movable lid for use with a laundry appliance is provided. The movable lid includes an intermediate element. The intermediate element includes a body having a first end and a second end. A fluid connector is positioned proximate the first end. An intermediate element outlet is positioned proximate the second end. The fluid connector is configured to be received within a portion of a fixed body of the laundry appliance such that a hinge axis about which the movable lid is configured to rotate is established.

These and other features, advantages, and objects of the present device will be further understood and appreciated by those skilled in the art upon studying the following specification, claims, and appended drawings.

BRIEF DESCRIPTION OF THE DRAWINGS

The device in question will now be detailed in depth based on the figures listed below, where.

DETAILED DESCRIPTION OF THE DEVICE

Figure 1:
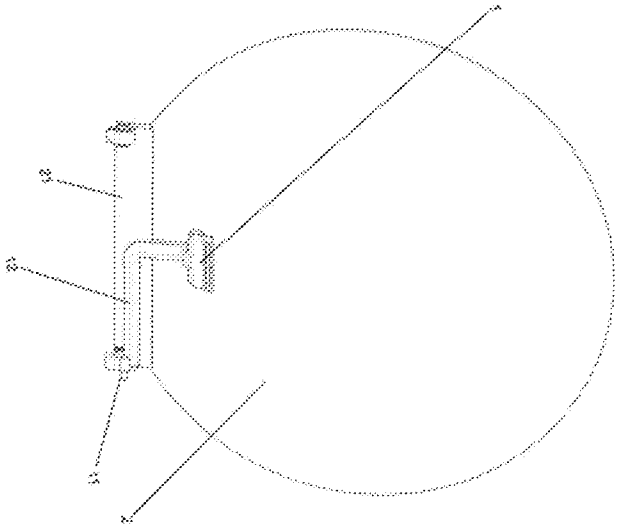
FIG. 1 (Prior Art)
FIG. 1 shows an input dispensing arrangement associated with the movable lid of a washing machine according to the state of the art.
Figure 2:
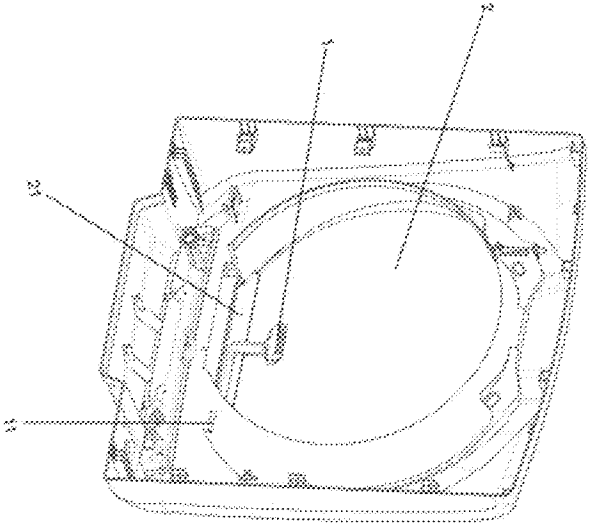
FIG. 2 (Prior Art)
FIG. 2 shows an input dispensing arrangement associated with the movable lid of a washing machine, already mounted in the plastic frame, according to the state of the art.
Figure 3:
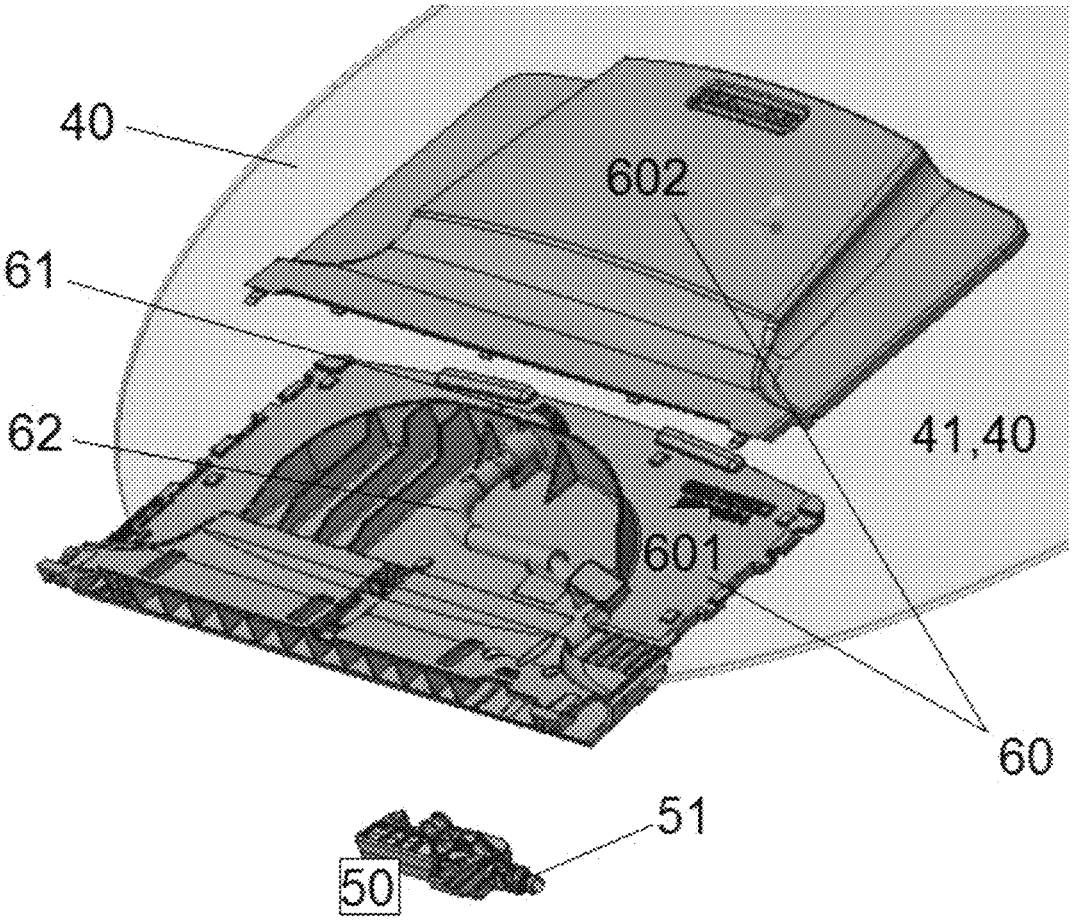
FIG. 3 shows an exploded view of an input dispensing arrangement associated with the movable lid of a washing machine according to the present device.
Figure 4:
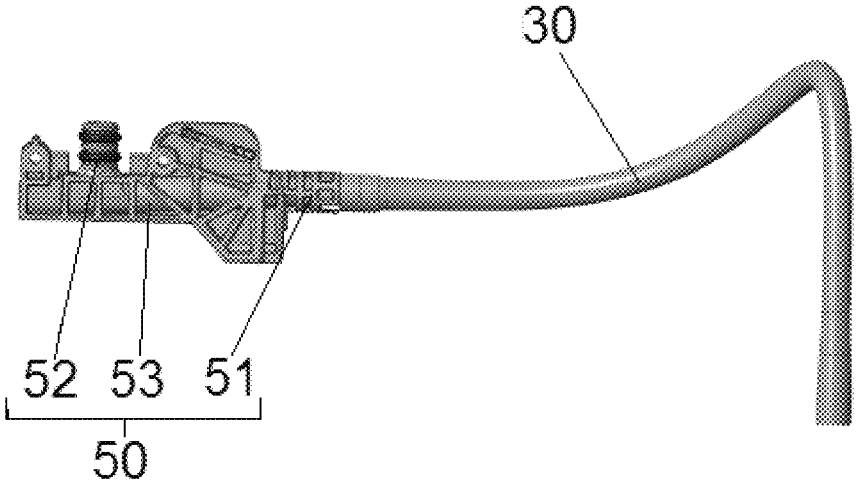
FIG. 4 shows a detailed view of part of the input dispensing set-up of the present device, showing the association between the intermediate element and the feed pipe.
Figure 5:
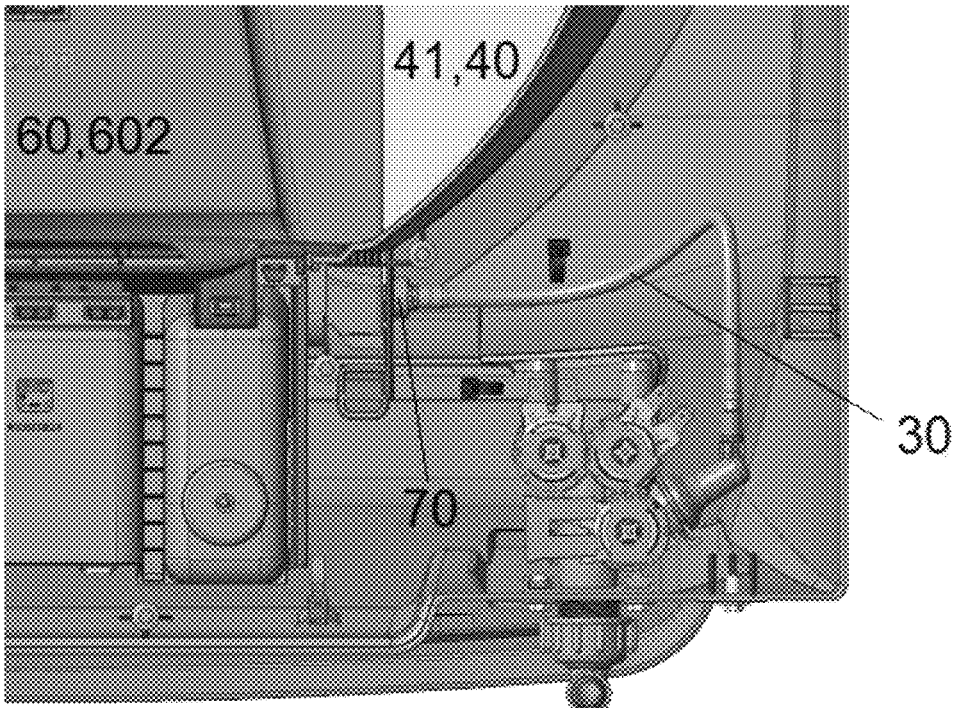
FIG. 5 shows an enlarged, bottom cross-sectional view of the household appliance incorporating the input dispensing set-up, according to the present device.

For purposes of description herein the terms "upper," "lower," "right," "left," "rear," "front," "vertical," "horizontal," and derivatives thereof shall relate to the device as oriented in FIG. 3. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

According to the main purposes of the device in question, a new structural arrangement is introduced in a set-up for dispensing of a household appliance is disclosed, the household appliance includes: at least one feed pipe 30, at least one movable lid 40 engaging a fixed body 70, at least one liquid flow driver 60 disposed adjacent to the lower face 41 of the movable lid 40; the liquid flow driver 60 being associated with the feed pipe 30 through a fluid connector 51, which defines a hinge axis of the movable lid 40, and the liquid flows through the liquid flow driver 60 being driven inside at least one washing environment defined inside the household appliance.

Particularly according to the present device, the fluid connector 51 includes an intermediate element 50, distinct from the liquid flow driver 60.

In other words, there is provided an intermediate element 50 which includes, in single piece, a body 53, the fluid connector 51 and, in addition to that, an intermediate element outlet 52, the latter two being preferably transversely disposed in relation to each other. The intermediate element 50 is a hollow body, of simple manufacture and relatively small and light.

The liquid flow driver 60, in turn, includes a driver outlet 61 to discharge the liquid into the at least one washing environment and an intermediate pipe 62, the intermediate pipe 62 fluidly connects the driver outlet 61 to the intermediate element outlet 52.

Since the fluid connection means 51 defines a passage of liquid between the feed pipe 30 and the intermediate pipe 62, as well as defines the pin/pivot axis of the hinge of the movable lid 40, the fluid connector 51 has a tubular cylindrical shape.

Preferably, the liquid flow driver 60 is split, being defined by a first portion 601 and a second portion 602, wherein the first portion 601 acts as a hinge frame, while the second portion 602 acts as a nozzle (spreader). Optionally, the second portion 602 can include a region that engages and couples to the movable lid 40.

The intermediate element 50 is mounted between the first and second portions 601, 602, being engaged and/or fastened to the first portion 601 by screws, quick fit, and/or other approaches. The attachment between the first and second portions 601, 602 of the liquid flow driver 60 may also occur in the same way.

A great advantage of the device in question lies in the fact that, since the intermediate element 50 is a simple, small, and light component, the intermediate element 50 can be easily mounted, by way of the fluid connector 51, to the fixed body 70 of the household appliance. The fixed body 70 of the household appliance may, for example, be the plastic frame and may bear the movable lid 40 without causing problems or difficulties in the subsequent steps of assembling the plastic frame itself next to the structural cabinet of the product. Additionally, this approach allows the movable lid 40 to be mounted on the semi-finished product by engagement between the first portion 601 with the body 53 of the intermediate element 50 itself, only in the final assemblage stages.

In addition, since the intermediate element 50 is integrated neither with the liquid flow driver 60 nor with the movable lid 40 to which the liquid flow driver 60 is attached, the latter two components can be disassembled and/or replaced, if necessary, by only disconnecting the liquid flow driver 60 from the intermediate element 50 without there being any need to disassemble the fixed body 70, namely the plastic frame in which the intermediate element 50 is received and housed.

According to the characteristics above, therefore, it is possible to simplify the manufacture of each of the parts of the set-up, to facilitate and to make its assembly more ergonomic, as well as to reduce the costs of possible exchanges of parts when one of the parts is faulty.

Lastly, it is also important to stress that the foregoing description has the sole objective of exemplarily describing the particular embodiment of the device in question. Therefore, it is clear that the modifications, the variations and the constructive combinations of elements performing the same function in substantially the same way in order to achieve the same results still fall under the scope of protection delimited by the claims.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A laundry appliance, comprising:

a movable lid that is configured to couple to a fixed body of the laundry appliance;

a nozzle that is coupled to the movable lid; and an intermediate element that comprises:

a body having a first end and a second end;

a fluid connector positioned proximate the first end; and an intermediate element outlet positioned proximate the second end, wherein the fluid connector is received within a portion of the fixed body, and wherein a coupling between the fluid connector and the portion of the fixed body establishes a hinge axis about which the movable lid is configured to rotate, and respective positions of the intermediate element and the nozzle, with respect to the fixed body, are simultaneously adjusted by adjusting a position of the movable lid relative to the fixed body.

2. Laundry appliance of claim 1, further comprising:

a feed pipe that is configured to fluidly couple with the fluid connector.

3. The laundry appliance of claim 1, wherein the fluid connector defines the hinge axis about which the movable lid rotates.

4. The laundry appliance of claim 1, further comprising:

a liquid flow driver disposed adjacent a lower face of the movable lid and fluidly coupled to the intermediate element, wherein the nozzle is integrated within the liquid flow driver.

5. The laundry appliance of claim 4, wherein the respective position of the intermediate element relative to the fixed body and a position of the liquid flow driver relative to the fixed body are simultaneously adjusted by adjusting the position of the movable lid relative to the fixed body.

6. The laundry appliance of claim 4, wherein the liquid flow driver comprises a first portion and a second portion.

7. The laundry appliance of claim 6, wherein the first portion receives the intermediate element.

8. The laundry appliance of claim 6, wherein the second portion acts as the nozzle for delivering fluid received by the fluid connector into a washing environment of the laundry appliance.

9. The laundry appliance of claim 1, wherein the fluid connector and the intermediate element outlet are transversely disposed relative to one another.

10. A laundry appliance, comprising:

a movable lid that is configured to couple to a fixed body of the laundry appliance;

a nozzle that is coupled to the movable lid;

an intermediate element that comprises:

a body having a first end and a second end;

a fluid connector positioned proximate the first end; and an intermediate element outlet positioned proximate the second end, wherein the fluid connector is received within a portion of the fixed body, and wherein the fluid connector defines a hinge axis about which the movable lid rotates such that a coupling between the fluid connector and the portion of the fixed body establishes the hinge axis about which the movable lid is configured to rotate, and wherein respective relative positions of the intermediate element and the nozzle, in relation to the fixed body, are each adjusted by adjusting a position of the movable lid relative to the fixed body; and a liquid flow driver disposed adjacent a lower face of the movable lid and fluidly coupled to the intermediate element and the nozzle.

11. The laundry appliance of claim 10, further comprising:

a feed pipe that is configured to fluidly couple with the fluid connector.

12. The laundry appliance of claim 10, wherein the liquid flow driver comprises a first portion and a second portion.

13. The laundry appliance of claim 12, wherein the first portion receives the intermediate element.

14. The laundry appliance of claim 12, wherein the second portion includes the nozzle for delivering fluid received by the fluid connector into a washing environment of the laundry appliance.

15. The laundry appliance of claim 10, wherein the fluid connector and the intermediate element outlet are transversely disposed relative to one another.

16. A movable lid for use with a laundry appliance, comprising:

a nozzle for delivering fluid; and an intermediate element that comprises:

a body having a first end and a second end;

a fluid connector positioned proximate the first end; and an intermediate element outlet positioned proximate the second end, wherein the fluid connector is configured to be received within a portion of a fixed body of the laundry appliance such that a hinge axis about which the movable lid is configured to rotate is established, wherein respective relative positions of the intermediate element and the nozzle, in relation to the fixed body, are each adjusted by adjusting a position of the movable lid relative to the fixed body.

17. The movable lid for use with a laundry appliance of claim 16, further comprising:

a liquid flow driver disposed adjacent a lower face of the movable lid and fluidly coupled to the intermediate element.

18. The movable lid for use with a laundry appliance of claim 17, wherein the liquid flow driver comprises a first portion and a second portion.

19. The movable lid for use with a laundry appliance of claim 17, wherein the first portion receives the intermediate element, and wherein the second portion acts as the nozzle for delivering the fluid received by the fluid connector into a washing environment of the laundry appliance.

20. The movable lid for use with a laundry appliance of claim 17, wherein the nozzle is integrated into the liquid flow driver.

* * * * *